US011754278B2

(12) United States Patent
Arni et al.

(10) Patent No.: US 11,754,278 B2
(45) Date of Patent: Sep. 12, 2023

(54) LUMINAIRE WITH SOUND DAMPENING PANEL

(71) Applicant: SIGNIFY HOLDING B.V., Eindhoven (NL)

(72) Inventors: Sohana K. Arni, Aurora, CO (US); Alexander J. Ross, Aurora, CO (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/795,247

(22) PCT Filed: Jan. 22, 2021

(86) PCT No.: PCT/EP2021/051412

§ 371 (c)(1),
(2) Date: Jul. 26, 2022

(87) PCT Pub. No.: WO2021/151783

PCT Pub. Date: Aug. 5, 2021

(65) Prior Publication Data

US 2023/0055585 A1 Feb. 23, 2023

Related U.S. Application Data

(60) Provisional application No. 62/966,433, filed on Jan. 27, 2020.

(30) Foreign Application Priority Data

May 28, 2020 (EP) ..... 20177095

(51) Int. Cl.
*F21V 33/00* (2006.01)
*F21S 8/06* (2006.01)
*F21Y 115/10* (2016.01)

(52) U.S. Cl.
CPC ..... *F21V 33/0056* (2013.01); *F21S 8/06* (2013.01); *F21Y 2115/10* (2016.08)

(58) Field of Classification Search
CPC ..... F21V 33/0056; F21V 17/16; F21V 33/00; F21V 99/00; F21S 8/06; F21S 8/061; F21Y 2115/10; F21Y 2103/33
See application file for complete search history.

(56) References Cited

U.S. PATENT DOCUMENTS

| | | | | |
|---|---|---|---|---|
| 10,746,917 | B2 * | 8/2020 | Ross | F21V 23/023 |
| 2018/0336875 | A1 | 11/2018 | Patterson et al. | |
| 2019/0338931 | A1 * | 11/2019 | Ross | F21V 7/10 |
| 2019/0339443 | A1 | 11/2019 | Ross et al. | |
| 2022/0026057 | A1 * | 1/2022 | Elmvang | F21V 19/02 |

FOREIGN PATENT DOCUMENTS

| | | | |
|---|---|---|---|
| BE | 1025855 | A1 | 7/2019 |
| BE | 1025885 | A1 | 7/2019 |
| WO | 2012110908 | A1 | 8/2012 |
| WO | 2020058528 | A1 | 3/2020 |

* cited by examiner

*Primary Examiner* — Bao Q Truong

(57) ABSTRACT

A luminaire comprising a housing, a light-emitting optic attached to the housing, and a cavity between the housing and the light-emitting optic. A circular acoustic panel is attached to a perimeter of the housing and being fully circumferential around the light-emitting optic.

13 Claims, 6 Drawing Sheets

LUMINAIRE WITH SOUND DAMPENING PANEL

CROSS-REFERENCE TO PRIOR APPLICATIONS

This application is the U.S. National Phase application under 35 U.S.C. § 371 of International Application No. PCT/EP2021/051412, filed on Jan. 22, 2021, which claims the benefit of U.S. Provisional Patent Application No. 62/966,433, filed on Jan. 27, 2020, and European Patent Application No. 20177095.5, filed on May 28, 2020. These applications are hereby incorporated by reference herein.

TECHNICAL FIELD

Embodiments of the technology relate generally to luminaires and more particularly to a luminaire with a sound dampening panel.

BACKGROUND

A luminaire is a system for producing, controlling, and/or distributing light for illumination. Luminaires are often referred to as light fixtures. The lighting industry has been transitioning to using light emitting diodes as the light source in luminaires. As compared to incandescent and fluorescent light sources, light emitting diodes (LEDs) offer substantial potential benefit associated with their energy efficiency, light quality, and compact size. However, applying LEDs for use in lighting systems offers both challenges and opportunities. In some cases, LED luminaires can provide additional functions or benefits beyond supplying illumination light for an area. WO2020/058528A1 discloses a luminaire with a housing, a light emitting optic, and a circular acoustic panel of concentric rings attached to a perimeter of the housing and being fully circumferential around the light emitting optic.

BRIEF DESCRIPTION OF THE FIGURES

Reference will now be made to the accompanying drawings, which are not necessarily drawn to scale, and wherein.

Figure 1:
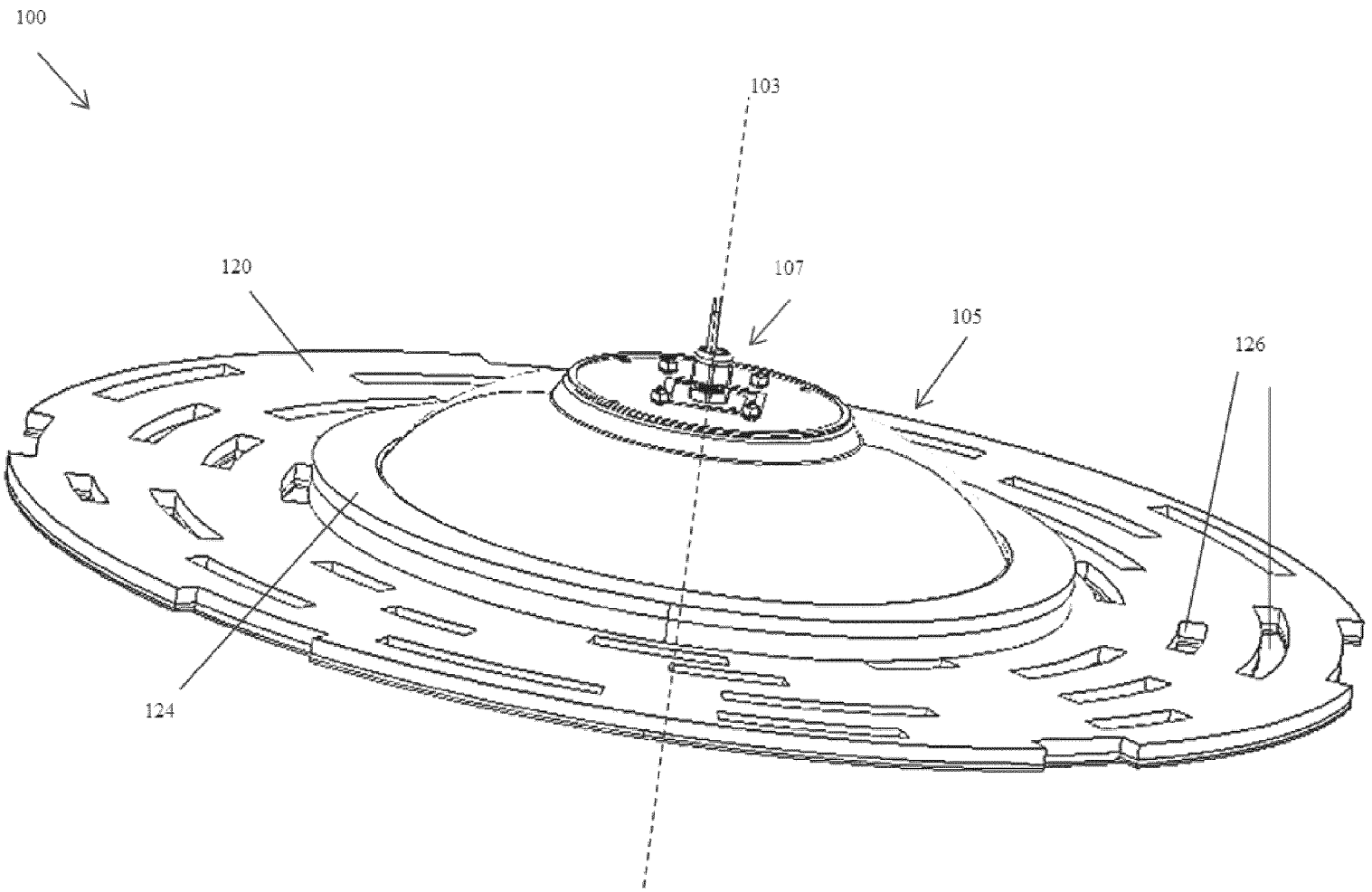
FIG. 1 illustrates a top perspective view of a luminaire according to an example embodiment of the present disclosure.
Figure 2:
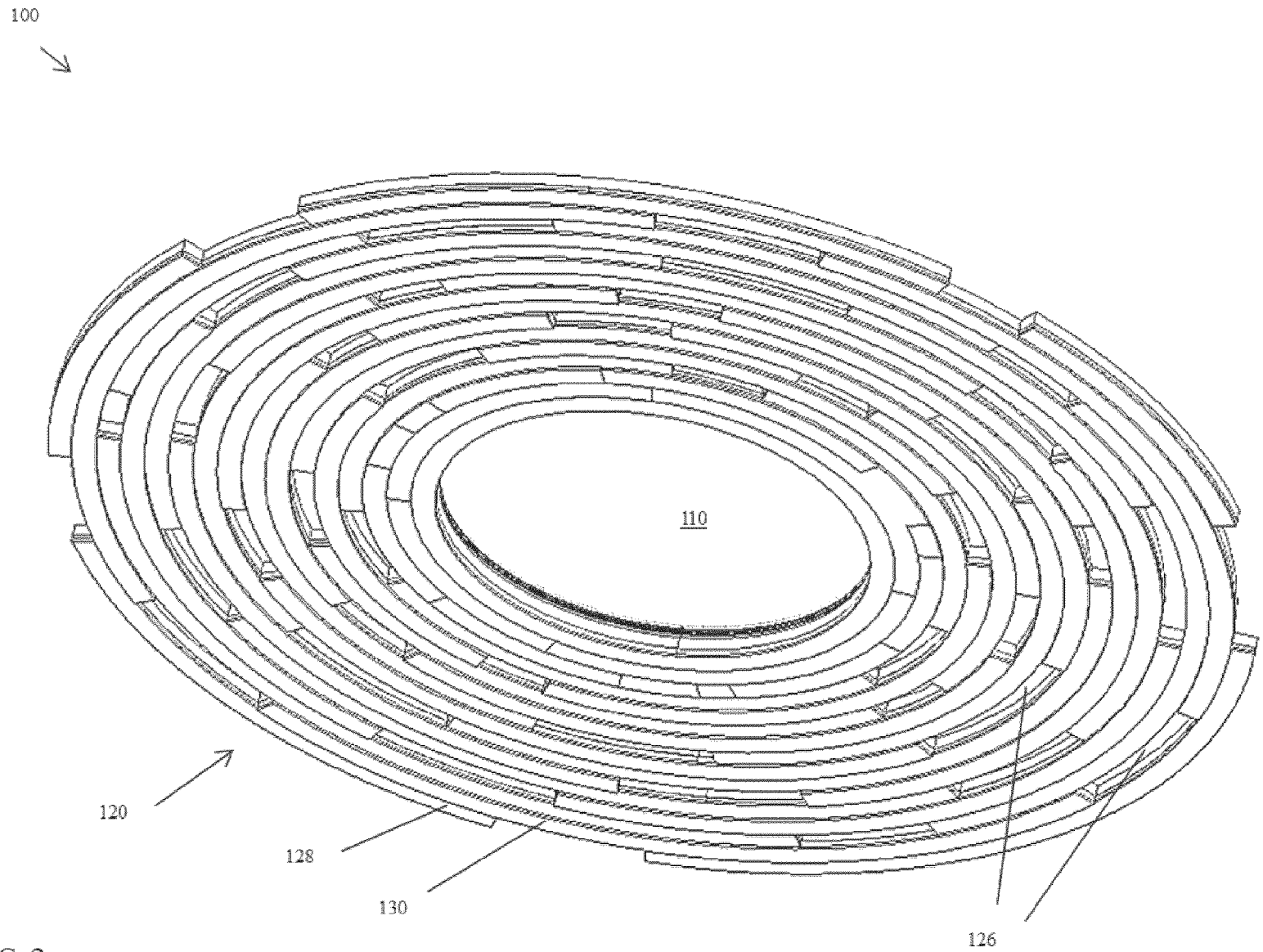
FIG. 2 illustrates a bottom perspective view of the luminaire of FIG. 1 according to an example embodiment of the present disclosure.
Figure 3:
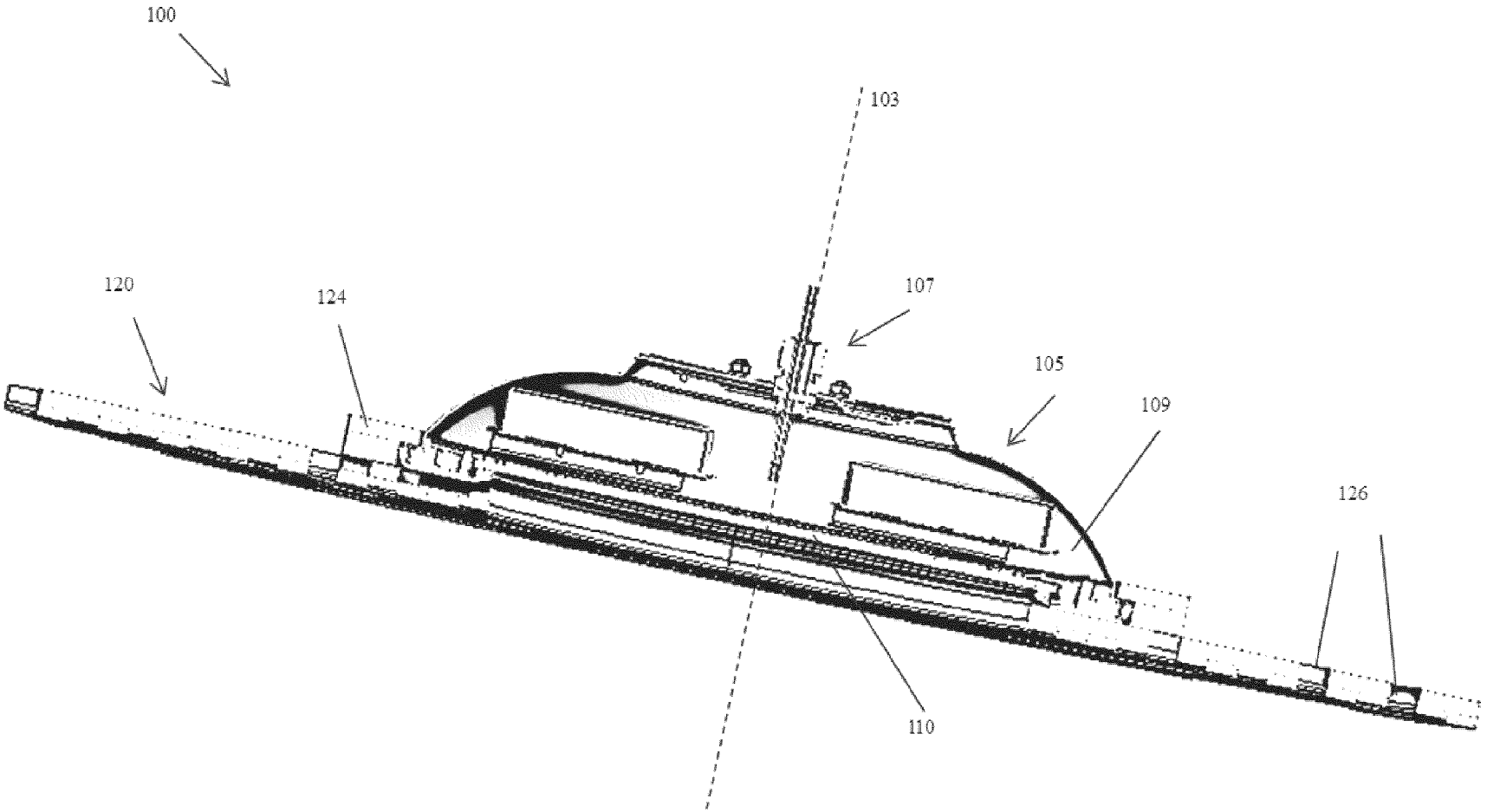
FIG. 3 illustrates a cross-sectional side view of the luminaire of FIG. 1 according to an example embodiment of the present disclosure.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in different drawings designate like or corresponding but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

The example embodiments described herein relate to luminaires that can be mounted to or suspended from a mounting structure (e.g., a ceiling, a wall) and that comprise an acoustic panel used for absorbing sound. The acoustic panels described herein have a unique shape to accommodate the shape of the luminaire. It should be appreciated that the embodiments herein can also apply to other types of luminaires having other shapes or configurations.

Referring now to FIGS. 1-6, a luminaire 100 is illustrated in accordance with an example embodiment of the present disclosure. Luminaire 100 comprises a housing 105, a light-emitting optic 110, and an acoustic panel 120 attached to a perimeter of housing 105. The housing 105 can comprise a housing backing 106 and a body 117 that can be joined along the perimeter of the housing by one or more fasteners 118. The body 117 can retain the light-emitting optic 110 in place with a gasket 112. The housing 105 and the light-emitting optic 110 enclose a cavity 109 that can contain components of the luminaire such as a power supply, wiring, and a light source. The housing 105 of the example luminaire 100 further comprises a rim 116 that extends outward from a perimeter of the luminaire 100. In the example shown in FIGS. 1-4, the rim is part of and extends outward from the body 117. A mounting 107 on the back side of the housing 105 can be used to mount or suspend the luminaire 100 from a ceiling, wall, or other supporting structure.

Figure 4:
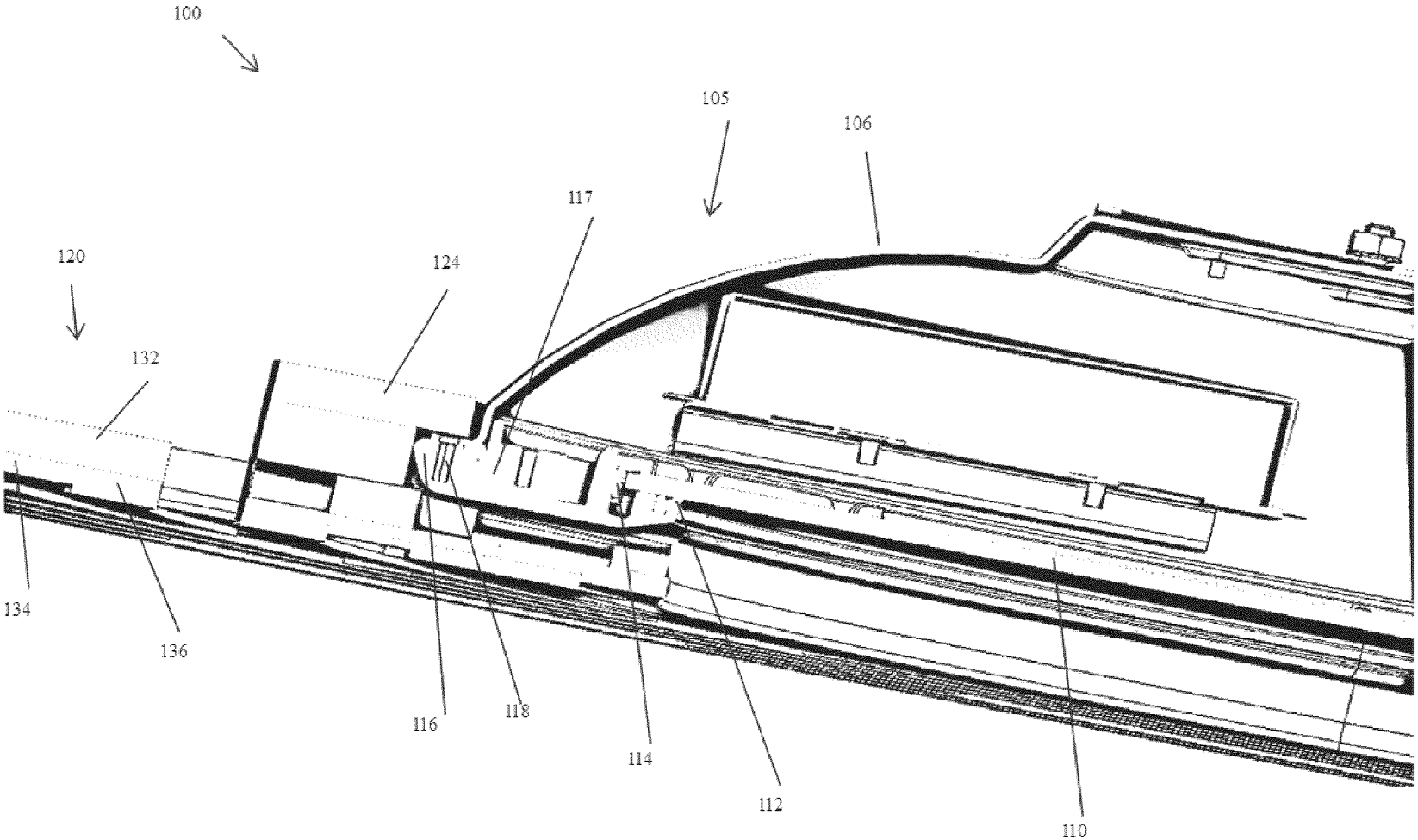
FIG. 4 illustrates an enlarged cross-sectional side view of a portion of the luminaire of FIG. 1 according to an example embodiment of the present disclosure.

One unique aspect of the luminaire 100 relates to the attachment of an acoustic panel 120 along the perimeter of the housing 105. As shown in FIG. 4, a clamping ring 124 of the acoustic panel 120 can be used to attach the acoustic panel 120 to the rim 116 of the luminaire 100. The clamping ring 124 is attached to the back side of the acoustic panel 120 and provides a recess into which the rim 116 can slide. In one example, one or more fasteners 118 can be located along the perimeter of the luminaire 100 and can pass through a top portion of the clamping ring 124 and can pass into the rim 116 to secure the acoustic panel 120 to the luminaire 100. In alternate embodiments, the acoustic panel 120 can be attached to the luminaire 100 using other arrangements.

As illustrated in FIGS. 1-6, the acoustic panel extends horizontally from the perimeter of the luminaire 100. In the example luminaire 100, the acoustic panel 100 comprises a plurality of rings, such as rings 128, 130, 134, and 136 that are joined to form the circular acoustic panel 120. Interspersed among the plurality of rings are optional apertures 126. As illustrated in FIG. 4, the acoustic panel can comprise a panel backing 132 to which the plurality of rings is attached. As further illustrated in FIG. 4, each of the plurality of rings can comprise a base that attaches to the panel backing 132 and a covering that faces downward from the bottom surface of the acoustic panel 120. The rings can have uniform or varying widths and heights. In the examples of FIGS. 1-6, the rings have varying heights so that the bottom surface of the acoustic panel 120 is non-planar. The non-planar character of the bottom surface of the acoustic panel 120 can improve the acoustic absorption performance of the acoustic panel 120 because sound waves tend to reflect more readily from planar surfaces. In the example shown in FIGS. 1-6, the rings have heights varying between 8 millimeters, 12 millimeters, and 16 millimeters, however, in other embodiments the rings can have other dimensions.

The acoustic panels can absorb sound which can be beneficial in large open areas or areas with significant noise. The acoustic panels can be made from one or more of a variety of materials known to be effective for absorbing sound such as foam, cork, felt, various polymers such as polyethylene terephthalate ("PET"), other porous materials, and combinations of the foregoing materials. In the examples of FIGS. 1-6, the base of each ring is made from PET and the covering of each ring that forms the bottom surface of the acoustic panel 120 is made from felt. In one example, PET can be softened by a heating process and pressed into curved shapes such as the shapes of the rings shown in FIGS. 1-6.

In the example luminaire 100, the light source comprises LEDs 114 mounted to the body 117 and arranged to direct light into light-emitting optic 110. In alternate embodiments, the light source can be in the form of one or more organic LEDs, a fluorescent light source, a halogen light source, or some other type of light source. Certain light sources such as LED light sources and fluorescent light sources require regulated power and, in those cases, the light sources can receive regulated power from a power supply. As non-limiting examples, the power supply can comprise one or more of a driver, a ballast, a switched mode power supply, an AC to DC converter, a transformer, or a rectifier that can provide regulated power to the light source. The power supply can be located within the cavity 109 and can receive AC power via a power cable that extends into the luminaire 100.

Figure 5:
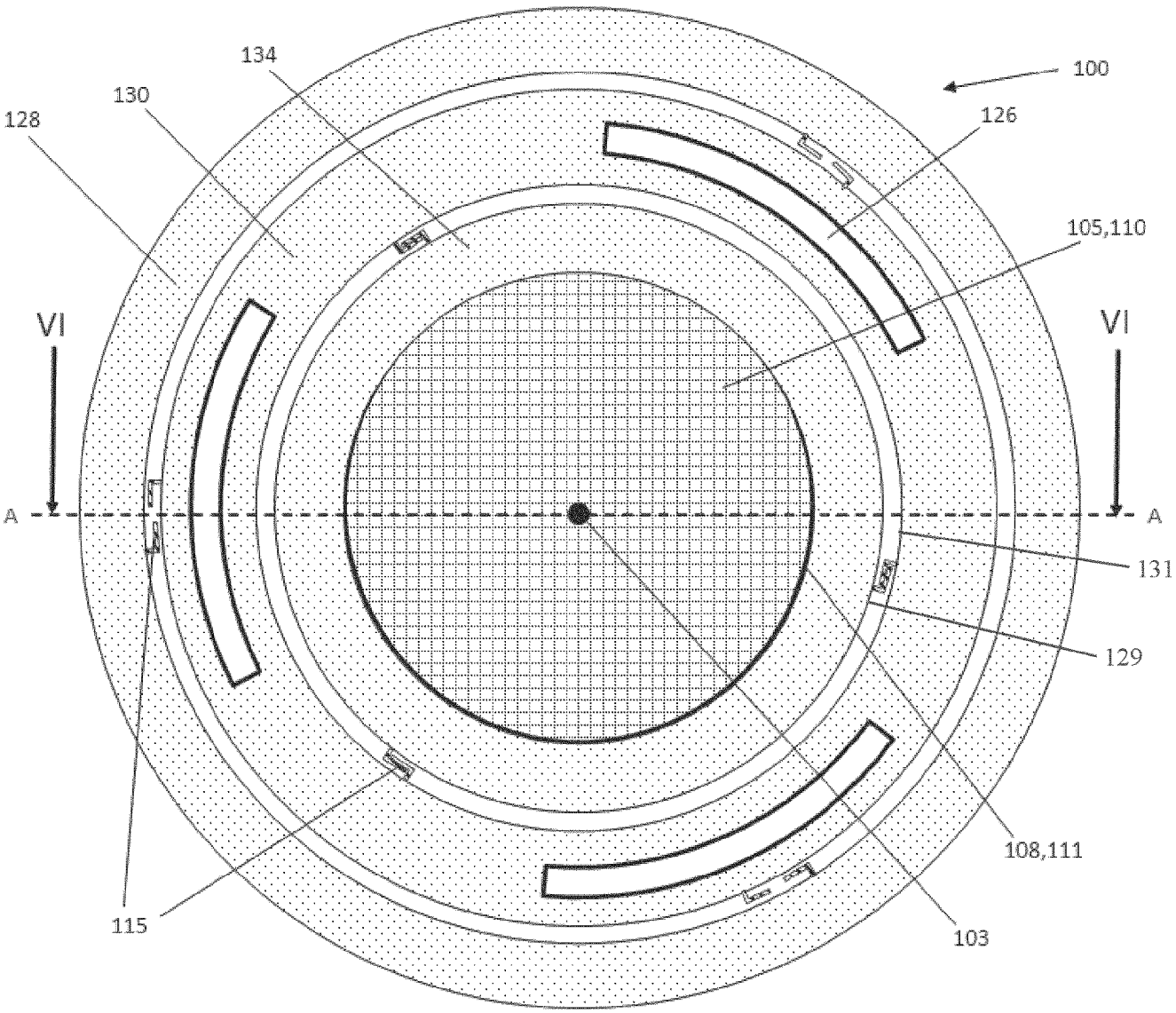
FIG. 5 illustrates a bottom view of another example of a luminaire according to the present disclosure.
Figure 6:
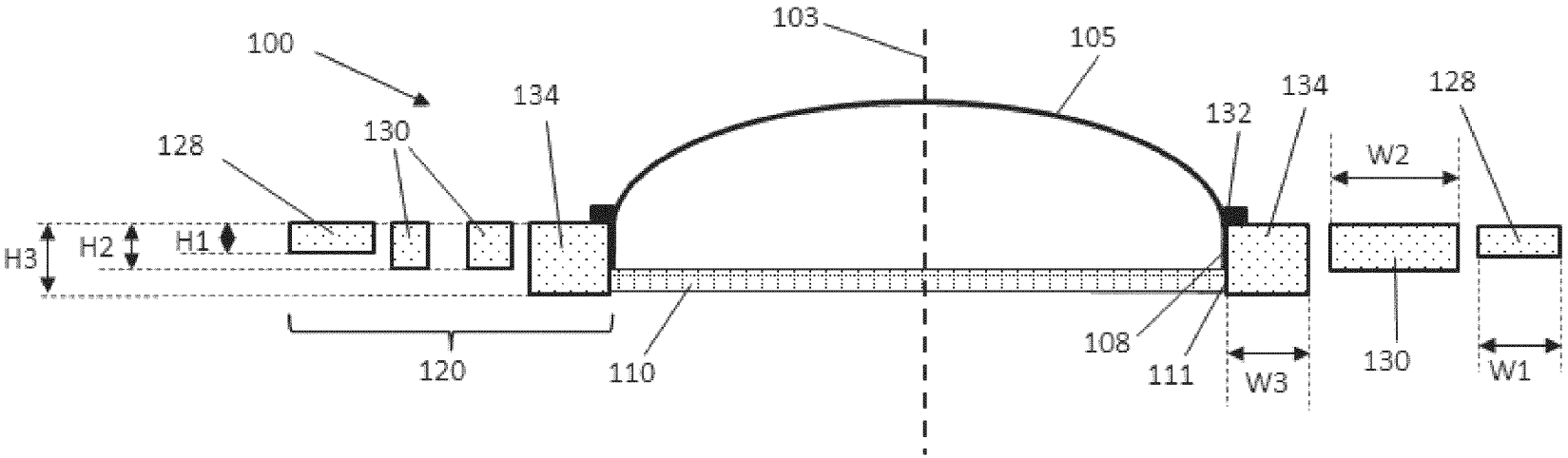
FIG. 6 illustrates a cross-sectional side view along line A-A of the luminaire of FIG. 5.

In the example luminaire 100 shown in FIGS. 5 and 6 an example is given of a modular system of the acoustic panel 120 comprising detachable sound absorbing rings 128,130, 134 concentric with respect to body axis 113. The concentric rings have different diameters and are mutually detachably connected by connection elements 115, snap-fitting hooks in this example. The connection elements are provided at an outer peripheral edge 129 of a first ring, which are attached to an inner peripheral edge 131 of a second ring arranged around the first ring. Detachable connected in this context is intended to mean enabling repetitive separation of the rings without fracture/breakage, for example via snap-fit, tongue and groove, Velcro, bajonet, screws, etc. . . . . The inner ring 134 is connected via the backing panel 132 to a perimeter 108 of the housing 105 and at the narrow perimeter 111 of the light-emitting optic 110, i.e. the light guide. The light-emitting optic 110 being essentially free from being partly or fully covered at either the front- and/or back-side by the acoustic panel 120, apart from at its narrow perimeter 111. One of the rings, i.e. the middle ring 130 is provided with apertures 126. The concentric rings 128, 130, and 134 each have a respective height H1, H2, and H3, and a respective width W1, W2, and W3 and essentially lie in the same plane. The difference in height of the concentric rings render the acoustic panel to be non-flat at its bottom-side, i.e. the side from which light is emitted from the light-emitting optic to the exterior, which can be considered as the acoustic element being tapering radially outwards from the central axis 113. The luminaire with the feature of the modularity of the sound absorbing rings renders the luminaire to have the advantage that its size in radial direction can be adjusted to the desired acoustic properties of the luminaire and adjustable to fit the available mounting space for the luminaire.

In another example, the power supply can be located remotely from the luminaire, such as in a plenum space above a ceiling from which the luminaire is suspended. The power supply can comprise class 1 connections for receiving power from a power source such as AC mains or grid power (e.g. 120 VAC, 230 VAC) from the electrical power grid or a renewable power source. The power supply can modify the power received from the power source and can comprise class 2 low voltage connections for coupling to the light source. The class 2 low voltage connections can supply low voltage power (e.g. 20 VDC to 60 VDC) via a low voltage cable to the light source of the luminaire. In certain embodiments, the low voltage power cable can also be the suspension cable that suspends the luminaire from a ceiling or other structure. In other embodiments, the low voltage power cable can be attached to and run alongside the suspension cable that suspends the luminaire from a ceiling or other structure.

As illustrated in FIGS. 1-6, light-emitting optic 110 is an edge lit lightguide that receives light from an LED light source disposed along the narrow perimeter of the lightguide. A lightguide can comprise a panel, slab, plate, or related form that can be flat or curved and that comprises two major faces that are internally reflective. Light can be introduced into the lightguide from a first edge of the lightguide, so that the major faces guide the light towards a second edge. One or both of the major faces can have features that provide a controlled release of light flowing through the lightguide, to illuminate an area. Light can thus propagate in the lightguide via internal reflection from the two major faces, traveling from the light-source edge towards an opposing edge, and illumination light can escape from the lightguide through the major faces. A light source can be positioned adjacent the first edge of the lightguide, so that the light source emits light into the lightguide via the first edge. In alternative embodiments, additional LEDs can be located adjacent to one or more of the other edges of the lightguide thereby directing light into the lightguide from the other edges. In yet other alternative embodiments, instead of positioning LEDs adjacent to one or more edges of the lightguide, certain edges can have a reflector located adjacent to one or more edges of the lightguide, the reflector reflecting light exiting the edge of the lightguide back into the edge of the lightguide. In yet other alternative embodiments, the lightguide can have a circular or round shape (as shown in FIGS. 1-6) with one continuous edge where LEDs are positioned along a portion of the lightguide edge and reflective material can be positioned along other portions of the lightguide edge. LEDs are an example of the light source that can be used with the lightguide, including but not limited to discrete LEDs, arrays of LEDs, and chip-on-board LEDs. In other embodiments, alternative light sources such as organic LEDs can be used.

In alternate embodiments, a light source can be located in the cavity 109 behind the light-emitting optic 110 and light can pass through the upper broad surface of the light-emitting optic 110 and exit the luminaire 100 through the lower broad surface of the light-emitting optic 110.

In certain example embodiments, the example luminaires described herein are subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures. Use of example embodiments described herein meet (and/or allow a corresponding device to meet) such standards when required.

Referring generally to the foregoing examples, any luminaire components (e.g., the housing components, the acoustic panels), described herein can be made from a single piece (e.g., as from a mold, injection mold, die cast, 3-D printing process, extrusion process, stamping process, or other prototype methods). In addition, or in the alternative, a luminaire (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

A fastener or attachment feature (including a complementary attachment feature) as described herein can allow one or more components and/or portions of an example luminaire to become coupled, directly or indirectly, to another portion or other component of a luminaire. An attachment feature can include, but is not limited to, a flange, a snap, Velcro, a clamp, a portion of a hinge, an aperture, a recessed area, a protrusion, a slot, a spring clip, a tab, a detent, and mating threads. A component can be coupled to a luminaire by the direct use of one or more attachment features.

In addition, or in the alternative, a portion of a luminaire can be coupled using one or more independent devices that interact with one or more attachment features disposed on the light fixture or a component of the light fixture. Examples of such devices can include, but are not limited to, a pin, a hinge, a fastening device (e.g., a bolt, a screw, a rivet), epoxy, glue, adhesive, tape, and a spring. One attachment feature described herein can be the same as, or different than, one or more other attachment features described herein. A complementary attachment feature (also sometimes called a corresponding attachment feature) as described herein can be a coupling feature that mechanically couples, directly or indirectly, with another coupling feature.

Terms such as "first", "second", "top", "bottom", "side", "distal", "proximal", and "within" are used merely to distinguish one component (or part of a component or state of a component) from another. Such terms are not meant to denote a preference or a particular orientation, and are not meant to limit the embodiments described herein. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the scope of the following claims, the scope of which are to be accorded the broadest interpretation so as to encompass modifications and equivalent structures.

The invention claimed is:

1. A luminaire comprising:

a housing;

a light-emitting optic attached to the housing;

a cavity between the housing and the light-emitting optic; and a circular acoustic panel attached to a perimeter of the housing and being fully circumferential around the light-emitting optic, wherein the circular acoustic panel comprises a plurality of concentric rings arranged in the same plane and having mutually different diameters, wherein the concentric rings are separate parts that are mutually, detachably mountable via connection elements wherein an outer peripheral edge of a first ring is attached to an inner peripheral edge of a second ring arranged around the first ring.

2. The luminaire of claim 1, wherein the circular acoustic panel attaches to a rim extending from the perimeter of the housing.

3. The luminaire of claim 2, wherein the circular acoustic panel comprises a clamping ring that attaches to the rim.

4. The luminaire of claim 1, wherein the light-emitting optic is an edge lit lightguide.

5. The luminaire of claim 1, wherein the light-emitting optic is a lens that covers a light source disposed in the cavity.

6. The luminaire of claim 1, wherein the plurality of rings is joined with an adhesive.

7. The luminaire of claim 1, wherein the plurality of rings comprises a first ring having a first height and a second ring having a second height, the second height being different from the first height.

8. The luminaire of claim 1, wherein the plurality of rings comprises a first ring having a first width and a second ring having a second width, the second width being different from the first width.

9. The luminaire of claim 1, wherein the circular acoustic panel comprises apertures.

10. The luminaire of claim 1, wherein the circular acoustic panel has varying thickness.

11. The luminaire of claim 1, wherein the circular acoustic panel has a bottom surface that is non-planar.

12. The luminaire of claim 1, wherein the luminaire is suspended from a ceiling or support structure.

13. The luminaire of claim 1, wherein the acoustic panel extends in a horizontal plane from the perimeter of the housing.

* * * * *